United States Patent [19]

Wiese et al.

[11] 4,055,105

[45] Oct. 25, 1977

[54] METHOD AND APPARATUS FOR VISUALLY LOCATING THE POSITION OF A FLOATING PISTON INSIDE OF A CYLINDER

[75] Inventors: Harold H. Wiese, Davenport, Iowa; James E. Wildman, Moline, Ill.

[73] Assignee: The United States of America as represented by the Secretary of the Army, Washington, D.C.

[21] Appl. No.: 691,047

[22] Filed: May 27, 1976

[51] Int. Cl.[2] ..... F41F 19/02

[52] U.S. Cl. ..... 89/43 R; 33/DIG. 15; 33/125 R

[58] Field of Search ..... 33/DIG. 15, 137, 138, 33/169 B, 181 AT, 180 AT, 125 R, 126, 126.5, 126.6; 89/43 R, 43 A; 116/114 AL, 124 D, 124 E; 73/323, 321, 314

[56] References Cited

U.S. PATENT DOCUMENTS

| | | | |
|---|---|---|---|
| 1,557,568 | 10/1925 | Dilley | 73/321 |
| 1,686,956 | 10/1928 | Bull | 33/138 |
| 2,348,362 | 5/1944 | Rudolf | 73/321 |
| 3,410,174 | 11/1968 | Hahn | 89/43 R |
| 3,546,941 | 12/1970 | Weighell | 73/321 |
| 3,599,530 | 8/1971 | Seamands | 89/43 R |

FOREIGN PATENT DOCUMENTS

| | | | |
|---|---|---|---|
| 409,047 | 2/1909 | France | 33/DIG. 15 |

*Primary Examiner*—Harry N. Haroian
*Attorney, Agent, or Firm*—Nathan Edelberg; Robert O. Richardson

[57] ABSTRACT

This invention relates to new and improved methods and apparatus to locate and indicate visually the position of a floating piston while inside its cylinder without the aid of movable means exterior of the cylinder and is especially usable in locating the floating piston separating the compressible gas from the hydraulic fluid in the recuperator cylinder assembly of the recoil-counter-recoil mechanism in a large caliber weapons system, such as the howitzer.

3 Claims, 2 Drawing Figures

METHOD AND APPARATUS FOR VISUALLY LOCATING THE POSITION OF A FLOATING PISTON INSIDE OF A CYLINDER

GOVERNMENT RIGHTS

The invention described herein may be manufactured and/or used by or for the Government for governmental purposes without the payment of any royalty thereon.

BACKGROUND OF THE INVENTION

Generally, the recoil mechanisms of some large caliber weapons systems employ a recuperator assembly including a cylinder having a floating piston separating the hydraulic fluid from a gas fluid. The position of the floating piston is usually monitored as an indicator to determine if an adequate volume of hydraulic fluid or gas exists in the cylinder to assure proper recoil operations of the weapon system.

In the past one method utilized to monitor the position of the piston has been to attach a rod to the piston which rod slidably extended at its other end through a seal in the cylinder whereby the external portion of the rod could be used to indicate the position of the piston in the cylinder. In weapon recoil systems the rod extended through the liquid side of the cylinder in the recuperator assembly because greater difficulties would be encountered in sealing of the gas side of the cylinder. The sealing requirements of the rod tended to lower the reliability of the hydraulic system. Even with this arrangement, sealing of the liquid side presented additional problems because of the high pressures involved in operation of the recuperator assembly. This rod approach presented further problems in that light-weight rods would tend to break and the rearward high speed travel of the rod could endanger crew (in one case the cylinder is approximately 80 inches long). The rod approach also required precision machined parts adding considerably to cost.

By utilizing the present invention these problems and difficulties, among others, of the prior art are substantially overcome by the provision of means for visually monitoring the position of the floating piston in the cylinder by connecting spring coil means to one end of the piston and mounting the other end of the spring coil means in the transparent gas side of the cylinder interior in a location where there is a high pressure resistant window through which the operator may view with minimum distortion the inside of the cylinder and read out sections of the spring means on which are marked indicia indicative of the position of the floating piston to determine whether the volume pressures in the cylinder are adequate.

Accordingly, it is an object of the present invention to provide new and improved means for visually monitoring the position of a floating piston in a cylinder to determine whether adequate fluid volume exists in the cylinder without removing the parts of the cylinder.

Another object of the present invention is to eliminate the necessity of utilizing a rigid rod carried by the piston which extends through the end of the cylinder and which carries readout indicia for indicating the position of said piston.

Still another object of the present invention is to eliminate the safety hazards attendant use of the rod indicating approach.

A further object of this invention is to eliminate the sealing requirements of the extending rod approach.

A still further object of the invention is to increase the reliability of high pressure cylinder assemblies, such as found in the recuperator assemblies of recoil mechanisms of large caliber weapons systems.

SUMMARY OF THE INVENTION

It has been found that these and other objects of the invention can be attained by the provision of a cylinder assembly including a cylinder housing and a floating piston separating the interior of the cylinder into two chambers. Located in one chamber wall is a sight glass through which the interior of one of the chambers can be viewed from the exterior of the cylinder. Attached at one end to the floating piston is spring coil means which is attached at its other end to the inner side of the wall of the cylinder in such a position that portions of the spring means are presented to the sight glass or window for viewing of those presented portions, whereby indicia marked on the presented portions of the spring means may be viewed to indicate to the viewer the position of the floating piston in the cylinder.

BRIEF DESCRIPTION OF THE DRAWINGS

These and other objects, features and advantages of the present invention will become readily apparent from the following description, when considered in conjunction with the accompanying drawings wherein like reference numerals indicate the same or corresponding parts in the views and wherein.

DESCRIPTION OF THE PREFERRED EMBODIMENT

Figure 1:
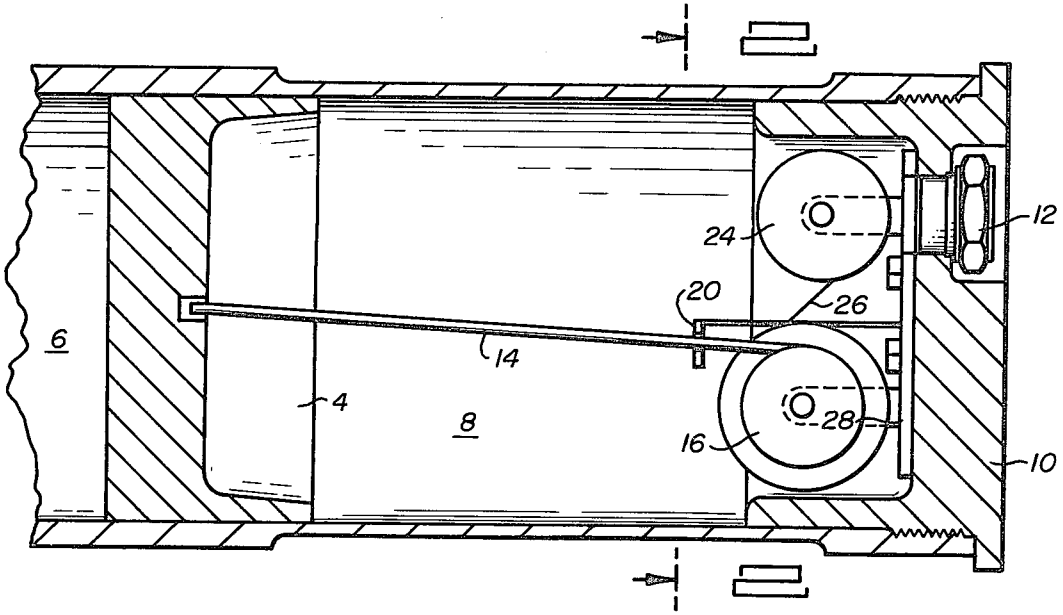
FIG. 1 is a sectional view of the invention with some parts in plan and other broken out to facilitate explanation.

Referring to FIG. 1 there is shown the invention in the environment of the recuperator assembly of the recoil mechanism of a large caliber weapons system.

The recuperator assembly includes a cylinder 2 closed at both ends (only one end being shown). In the cylinder 2 is located a floating piston 4 reciprocably movable in the cylinder and dividing the cylinder interior into two chambers, a hydraulic fluid chamber 6 and a high-pressure compressible gas chamber 8. The gas used is preferably a transparent gas for purposes which will become apparent hereafter.

Mounted in the end cap or closure plate 10 on the gas chamber side of the cylinder 2 is a commercially available high pressure resistant sight glass or window 12 through which the interior of the gas chamber 8 can be viewed from the exterior of the cylinder 2.

Axially carried by the piston 4 at one end is a flexible cable means 14 which preferably is a round strand cable. At its other end the cable 14 is wound about spool means 16 and fixedly attached at its end to the spool means 16. The spool means 16 is rotatably carried by a bracket 28 which in turn is mounted to the end cap 10. The bracket spaces the spool means 16 from the end cap 10. Also carried by the end cap 10 is a guide means 20 through which the cable 14 passes. As readily appears from FIG. 2, the guide means is located adjacent the spool means 16 and is intended to assist in preventing the cable 14 from jumping the track of the spool 16 when the spool is rotating. The length of the cable is initially determined by the preferred displacement of the piston.

Spaced from spool means 16 and rotatably carried by a bracket 28 also mounted to cap 10 is a second spool means 24 which is positioned to permit viewing through window 12 of selected portions of a constant force load spring means 26 carried by and attached at one end to the second spool means 24. A suitable flat constant force load spring is the "Negator" spring sold under that trade name by the Hunter Spring Division of AMATEK of Lansdale, PA.

Figure 2:
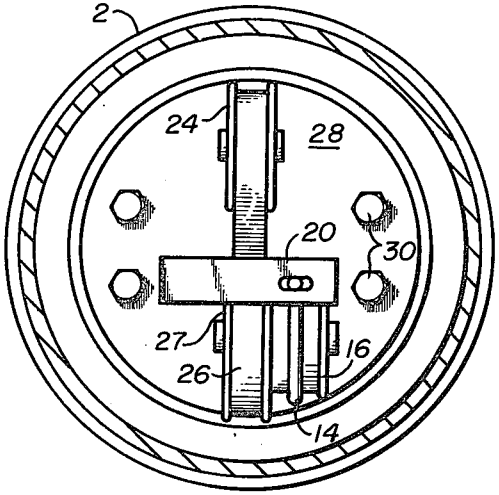
FIG. 2 is a sectional view taken along line 2—2 of FIG. 1.

The other end of the spring 26 is wound about and connected to an auxiliary spool means 27 axially aligned with and carried for rotation with the first spool means 16. The second spool means 24 and auxiliary spool means 27, are in alignment, as best seen in FIG. 2 to permit winding and unwinding of the spring means 26.

The outside surface of the spring means 26, facing the sight window 12, in selected positions thereon has indicia, such as color coding (not shown), for indicating to a viewer through the sight glass 12 what the position of the piston 4 is in the cylinder 2.

If desired for ease of assembly, the spools, brackets, and guide may be first attached on a mounting plate 28 which can be then secured as a unit to the end cap, as by bolts 30.

In operation, the load spring 26 holds the spring means 26 and cable 14 under tension. When the piston 4 moves, the cable 14 follows the piston and its end attached to spool means 16 winds or unwinds under the influence of the spring means 26 depending upon the direction of movement of the piston. The selected portions of the flat spring 26 which are marked with indicia can be viewed through the sight window 12 to determine the position of the piston in the cylinder. Where a transparent gas is used in the gas chamber 8 the viewing of the viewer may be unimpaired.

Thus it can be observed that, with the present invention means are provided for permitting the inspection of an indicator device located entirely inside of a cylinder to determine the relative position of a piston in the cylinder without the necessity of using indicator devices having parts internal and external of the cylinder thereby eliminating the necessity for seals for such external parts, eliminating the necessity for precision machining of parts for such external devices and eliminates the safety hazards attendant use of such external devices. Moreover, where the invention hereof is used in the recuperator assembly of recoil mechanisms of weapons, firing of the weapon can be continued even if components of the indicator device should break.

We wish it to be understood that we do not desire to be limited to the exact details of construction shown and described, for modifications will occur to a person skilled in the art.

We claim:

1. A recuperator assembly of a recoil mechanism of a weapon system wherein said recuperator assembly includes a cylinder with a piston therein separating the interior of the cylinder into a high pressure fluid chamber and a high pressure gas chamber, means adapted for visually displaying the interior of the gas chamber and indicating the position of the piston in the cylinder including sight glass means carried by said cylinder for visually displaying the interior of said gas chamber to the exterior thereof, said sight glass means comprising a window located in an end wall of said cylinder, movable means in the gas chamber including a connection movable with said piston, said movable means being positioned for viewing through said sight glass means and being movably responsive to piston movement through said connection and, indicia means on said movable means viewable through said sight glass means for indicating the position of said piston in said cylinder, said movable means comprising spool means carried by said end wall of said cylinder and comprising first, second and third spools, said first and third spools being co-axial and movable with each other, said second spool being located at a distance from said first and third spools in vertical alignment with said third spool, said second spool being positioned with its surface located in the line of sight of said window and having indicia means carried thereby, said connection comprising a cable carried at one end by said piston and wound on and attached at its other end to said first spool, a constant force load spring attached to, carried by and wound partially on said second spool at one end thereof, said spring being attached, carried by and wound on said third spool.

2. The assembly of claim 1 including guide means for said cable located adjacent said first spool to prevent the cable from leaving the spool.

3. The assembly of claim 1 wherein the surface of said spring wound on the second spool located in the line sight of said window carries said indicia means.

* * * * *